US010954682B2

(12) United States Patent
Blanc

(10) Patent No.: US 10,954,682 B2
(45) Date of Patent: Mar. 23, 2021

(54) TOOL FOR CLEANING A POOL, PARTICULARLY IN A RADIOACTIVE ENVIRONMENT, COMPRISING A TANK

(71) Applicant: Orano DS—Démantèlement et Services, Gif-sur-Yvette (FR)

(72) Inventor: Thierry Blanc, Jujurieux (FR)

(73) Assignee: ORANO DS - DÉMANTÈLEMENT ET SERVICES, Gif-sur-Yvette (FR)

( * ) Notice: Subject to any disclaimer, the term of this patent is extended or adjusted under 35 U.S.C. 154(b) by 281 days.

(21) Appl. No.: 16/315,001

(22) PCT Filed: Jun. 30, 2017

(86) PCT No.: PCT/FR2017/051775

§ 371 (c)(1),
(2) Date: Jan. 3, 2019

(87) PCT Pub. No.: WO2018/007730

PCT Pub. Date: Jan. 11, 2018

(65) Prior Publication Data

US 2019/0234092 A1 Aug. 1, 2019

(30) Foreign Application Priority Data

Jul. 4, 2016 (FR) ..... 16 56372

(51) Int. Cl.
*E04H 4/16* (2006.01)
*G21F 9/06* (2006.01)
(Continued)

(52) U.S. Cl.
CPC ..... *E04H 4/16* (2013.01); *G21F 9/00* (2013.01); *G21F 9/06* (2013.01); *G21F 9/22* (2013.01)

(58) Field of Classification Search
None
See application file for complete search history.

(56) References Cited

U.S. PATENT DOCUMENTS 3,674,148 A * 7/1972 Miller ..... B01D 35/02 210/409
7,926,515 B2 * 4/2011 Jung ..... F15B 21/041 137/884
(Continued)

FOREIGN PATENT DOCUMENTS

EP 1022411 A2 7/2000
EP 1 191 166 A1 3/2002
(Continued)

OTHER PUBLICATIONS

International Search Report for International Application No. PCT/FR2017/051775, dated Nov. 14, 2017 .
(Continued)

*Primary Examiner* — Robert J Popovics
(74) *Attorney, Agent, or Firm* — Pearne & Gordon LLP

(57) ABSTRACT

A tool for cleaning a pool, particularly in a radioactive environment. The tool comprises a liquid filtering device, a pump, and a tank. The tank comprises an inlet for liquid from the pool. The tank at least partly houses the filtering device and the pump. The filtering device is arranged between the inlet and the pump so as to fluidically connect said inlet and pump.

11 Claims, 3 Drawing Sheets

(51) Int. Cl.
*G21F 9/22* (2006.01)
*G21F 9/00* (2006.01)

(56) References Cited

U.S. PATENT DOCUMENTS 8,048,319 B2 * 11/2011 Smith ..... B01D 29/15 210/767
8,054,932 B2 * 11/2011 Smith ..... B01D 35/02 376/282
8,123,939 B2 * 2/2012 Chu ..... G21F 9/36 210/232
8,672,639 B2 * 3/2014 Wallace ..... F04F 3/00 417/36
8,771,509 B2 * 7/2014 Huang ..... C02F 11/121 210/237
8,877,054 B2 * 11/2014 Andersen ..... B01D 35/303 210/232
2006/0021920 A1 * 2/2006 Forbes ..... A01K 63/045 210/108
2008/0061010 A1 * 3/2008 Tom ..... A01K 63/045 210/767
2012/0171051 A1 * 7/2012 Wallace ..... F04B 53/20 417/53
2012/0234744 A1 * 9/2012 Lawson ..... A01K 63/045 210/295
2019/0234092 A1 * 8/2019 Blanc ..... G21F 9/22

FOREIGN PATENT DOCUMENTS

EP 2 940 695 A1 11/2015
FR 2 742 351 A1 6/1997
WO 2013/030005 A1 3/2013
WO 2015/040248 A1 3/2015
WO WO-2018007730 A1 * 1/2018 ..... G21F 9/00

OTHER PUBLICATIONS

Written Opinion for International Application No. PCT/FR2017/051775, dated Nov. 14, 2017.
Preliminary French Search Report for Application No. 1656372, dated Apr. 21, 2017.

* cited by examiner

TOOL FOR CLEANING A POOL, PARTICULARLY IN A RADIOACTIVE ENVIRONMENT, COMPRISING A TANK

CROSS-REFERENCE TO RELATED APPLICATIONS

This is a National Stage application of PCT international application PCT/FR2017/051775, filed on Jun. 30, 2017, which claims the priority of French Patent Application No. 16 56372, filed Jul. 4, 2016, both of which are incorporated herein by reference in their entirety.

TECHNICAL FIELD

The invention relates to a tool for cleaning a pool in a radioactive environment. The cleaning tool is capable of being submerged at least partly in the pool.

STATE OF THE PRIOR ART

Cleaning tools with known structures for storage pools for radioactive materials, in particular nuclear fuel assemblies, comprise a chassis, a suction device and a filtration device situated downstream of the suction device. The suction device and the filtration device are mounted on the chassis. They are used to clean the water in the pool and/or in recovering bodies which are resting on the bottom of the pool.

Such cleaning tools are rather difficult to move and to install in the pool. The maintenance operations of these tools are often awkward. Moreover, they are likely to be contaminated by the radioactivity of elements, parts or bodies, particularly those resulting from maintenance or handling operations which may have fallen or been deposited in the bottom of the pool.

DISCLOSURE OF THE INVENTION

The invention aims to resolve at least partly the problems encountered in the solutions of the prior art.

In this regard, the invention has as its object a tool for cleaning a pool in a radioactive environment. The cleaning tool comprises a liquid filtration device and at least one pump.

According to the invention, the tool comprises one tank which includes a first opening, an inlet for liquid from the pool and a liquid outlet.

The first opening is designed to introduce the pump at least partly into it, and to accommodate the pump at least partly in the tank. The second opening, distinct from the first opening, is designed to introduce the filtration device at least partly into it, and to accommodate the filtration device at least partly in the tank. The liquid inlet leads into the second opening, the filtration device being situated between the inlet and the pump to fluidly connect the liquid inlet to the pump.

The tool also comprises a cover configured to close the first opening, and a pressure pipe which is fluidly connected to the outlet of the pump and to the liquid outlet. The pressure pipe passes through the cover. The pump and the pressure pipe are rigidly integrated into the cover.

The cleaning tool is configured to aspire liquid from the pool from the inlet, then through the filtration device, before having it pass through at least one pump.

Thanks to the invention, the risks of contaminating the pump by radioactive elements, particles, parts or bodies are reduced, because the filtration device is designed to retain these elements before they reach the at least one pump. The filtration device is situated immediately downstream of the liquid inlet, which limits the contamination of the tank and of the pump.

Moreover, the filtration device and the at least one pump are accessible independently from one another, which facilitates maintenance operations. In addition, the pumping unit, which comprises the pump, the cover of the first opening and the pressure pipe, can be displaced/withdrawn in one piece from the tank, which facilitates maintenance operations in particular.

The invention can optionally include one or more of the following features, combined together or not.

Advantageously, the pump is attached to the tank, and the filtration device is attached to the tank.

The movement of the cleaning tool and its installation in the pool are then facilitated.

According to one characteristic embodiment, the tank comprises at least one cover designed to block the second opening and a closure system for the cover. The closure system for the cover comprises a lever and two linear actuator rods, each connected on the one hand to the tank and on the other hand to the lever, to cause the cover to tilt relative to the tank.

In this configuration, the cover of the second opening can have no screws or rivets to close it, which facilitates its opening when the tool is at the bottom of the pool.

According to one advantageous embodiment, the cleaning tool includes a valve configured to close the pressure pipe. The valve is situated opposite to the pump with respect to the cover of the first opening.

Advantageously, the cleaning tool comprises a second pump accommodated in the tank by being introduced into a third opening distinct from the first opening, the first opening and the third opening being situated on either side of the second opening for the introduction of the filtration device, the filtration device being accommodated in the tank between the pumps in a longitudinal direction of the tank.

According to one characteristic embodiment, the cleaning cool includes a drainage valve situated at the exterior of the tank and configured to drain the tank.

The drainage valve is then easily accessible.

The invention also applies to a cleaning apparatus for a pool in a radioactive environment. The apparatus comprises a cleaning tool as defined above, and a control and/or power supply unit configured to control the at least one pump and/or supply electrical power to the pump from outside the pool when the cleaning tool is at the bottom of the pool.

According to an advantageous embodiment, the cleaning tool comprises an inlet pipe fluidly connected to the inlet of the cleaning tool, the inlet pipe being configured to suck the liquid at the surface of the pool or at the bottom of the pool.

The cleaning tool thus allows both cleaning the liquid in the pool, sucking radioactive elements resting on the bottom of the pool and sucking those floating on the surface of the pool, particles or foams for example.

According to another advantageous embodiment, the inlet comprises at least one inlet tube, the apparatus comprising a nozzle adapter which connects fluidly the inlet pipe to the inlet tube, the nozzle adapter comprising a gripping lug and a frusto-conical surface configured to insert the nozzle adapter into the inlet tube.

In this case, the connection of the inlet pipe to the inlet tube is facilitated.

The invention also relates to a method for cleaning a pool by means of a cleaning tool as defined above, and/or a cleaning apparatus as defined above. The cleaning method comprises a step of submerging the cleaning tool in the pool, the tanks being previously filled with a first liquid having fewer or being free of contaminants for the pump.

The liquid initially present in the tank is then discharged out of the tank, which causes suction of water from the inlet pipe and the cleaning of this water.

In addition, the invention relates to a method of remotely connecting an inlet pipe to an inlet tube of a cleaning apparatus as defined above. The method comprises a step of grasping the nozzle adapter by its lug from the outside of the pool, and a step of inserting the nozzle adapter into the inlet tube from the outside of the pool.

The inlet pipe can then be changed while the tank remains on the bottom of the pool, which limits the risk of exposing an operator to the radiation and to radioactive contamination.

BRIEF DESCRIPTION OF THE DRAWINGS

The present invention will be better understood upon reading the description of exemplary embodiments, given purely indicatively and in no way limiting, referring to the appended drawings in which.

DETAILED DISCLOSURE OF PARTICULAR EMBODIMENTS

Identical, similar or equivalent portions of the different figures bear the same numerical references so as to facilitate passage from one figure to another.

Figure 1:
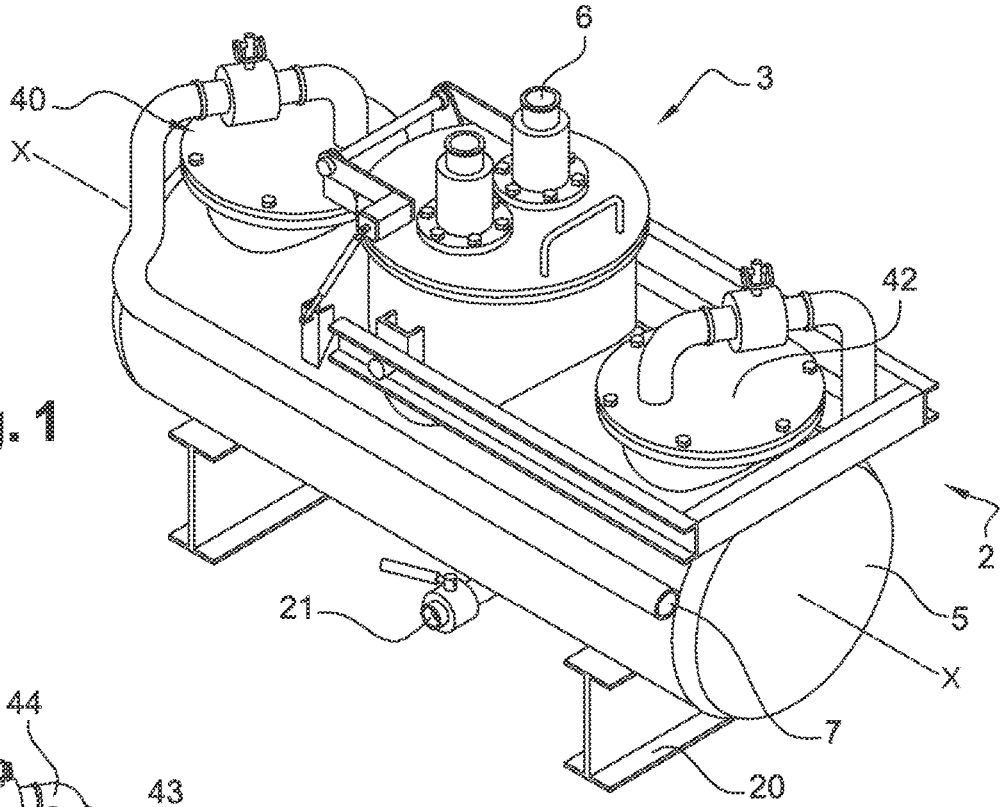
FIG. 1 is a schematic view in elevation of a cleaning tool for a pool, according to a first embodiment.
Figure 2:
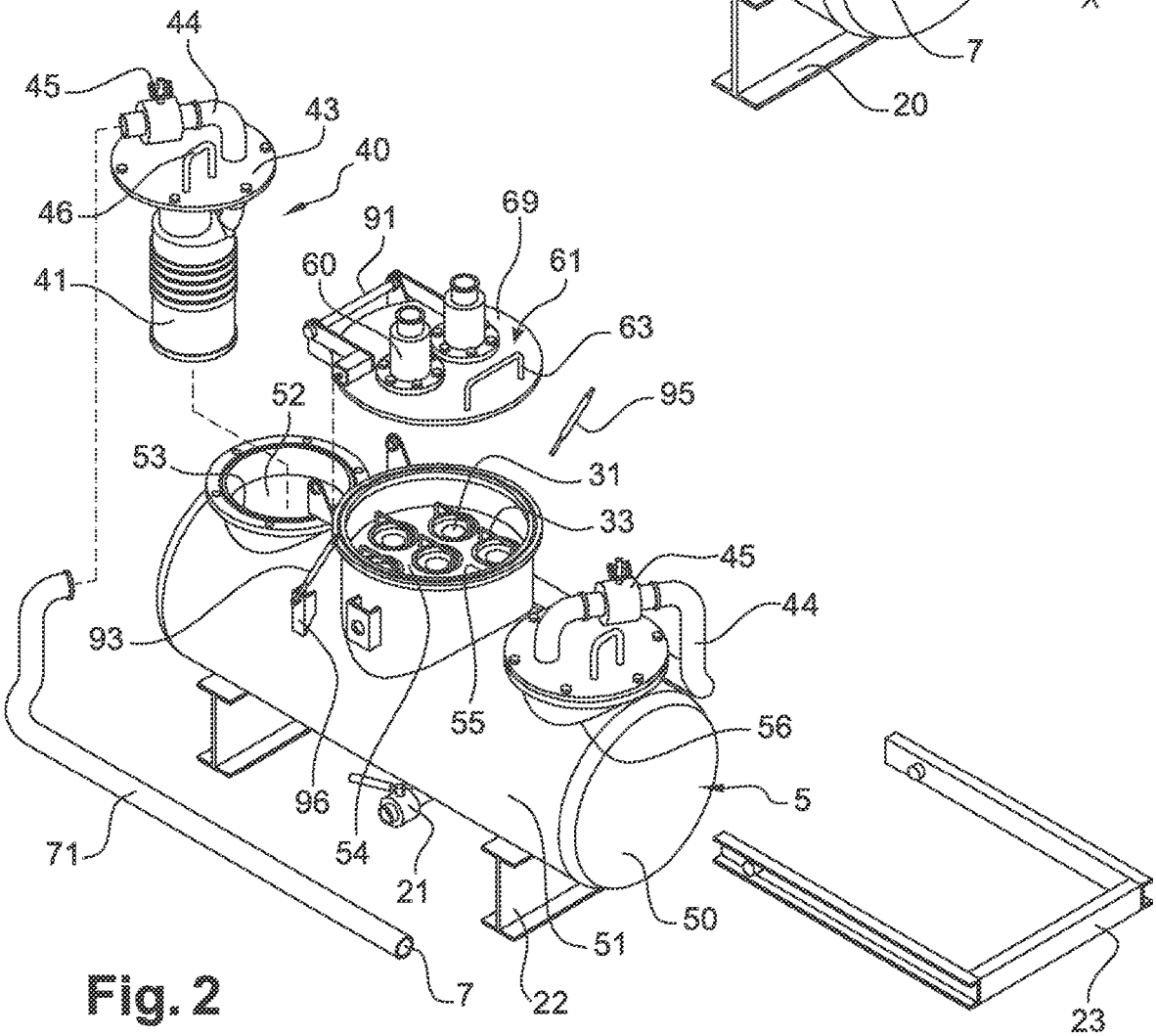
FIG. 2 is an exploded schematic view of the cleaning tool according to the first embodiment.

FIGS. 1 and 2 show a cleaning tool 2 for a pool 10 for storing radioactive materials.

Figure 4:
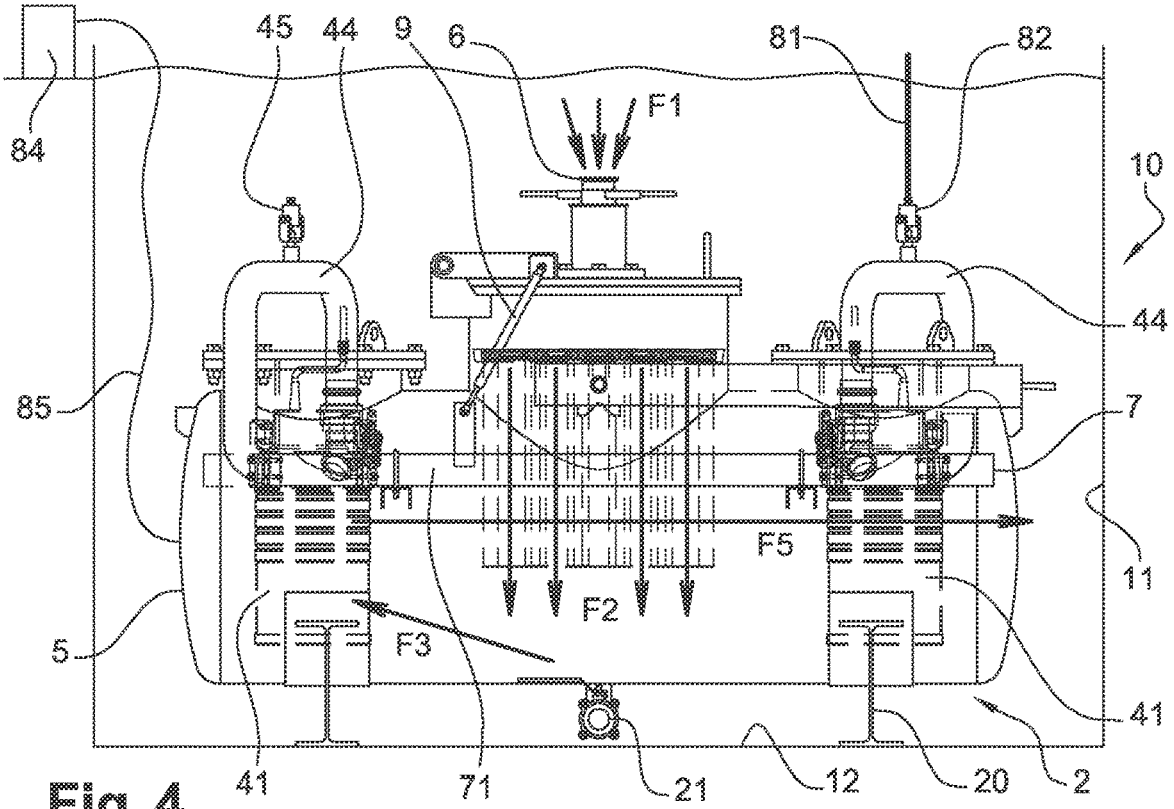
FIG. 4 illustrates the cleaning of the environment of a pool using the cleaning tool according to the first embodiment.
Figure 5:
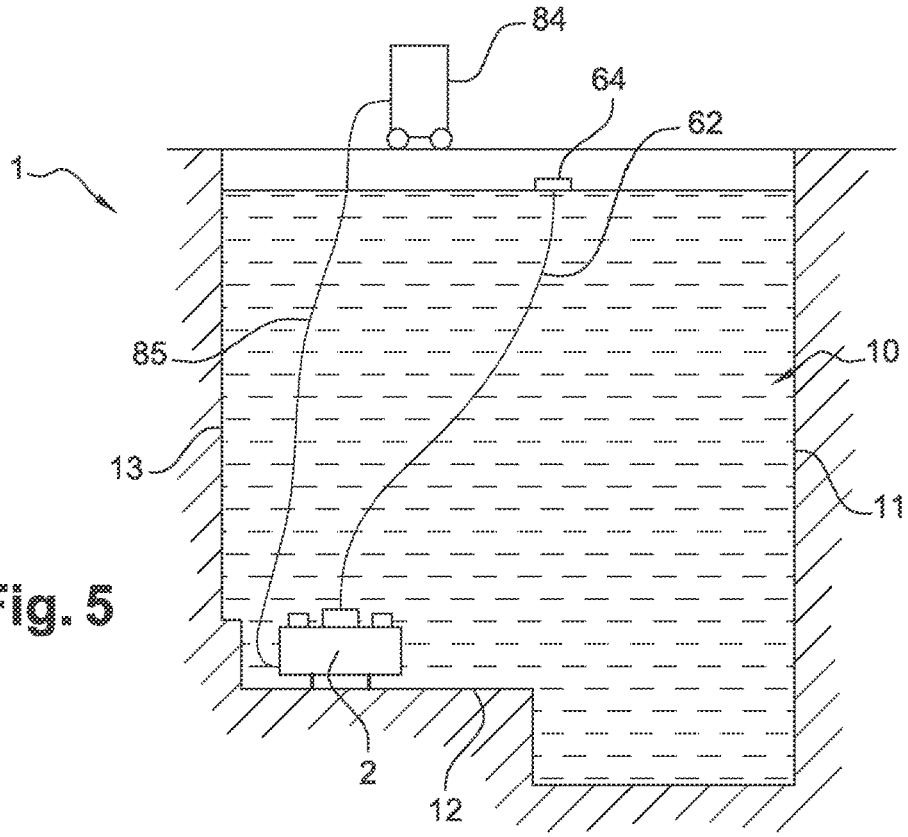
FIG. 5 illustrates the cleaning of the surface of the pool using the cleaning tool according to the first embodiment.
Figure 6:
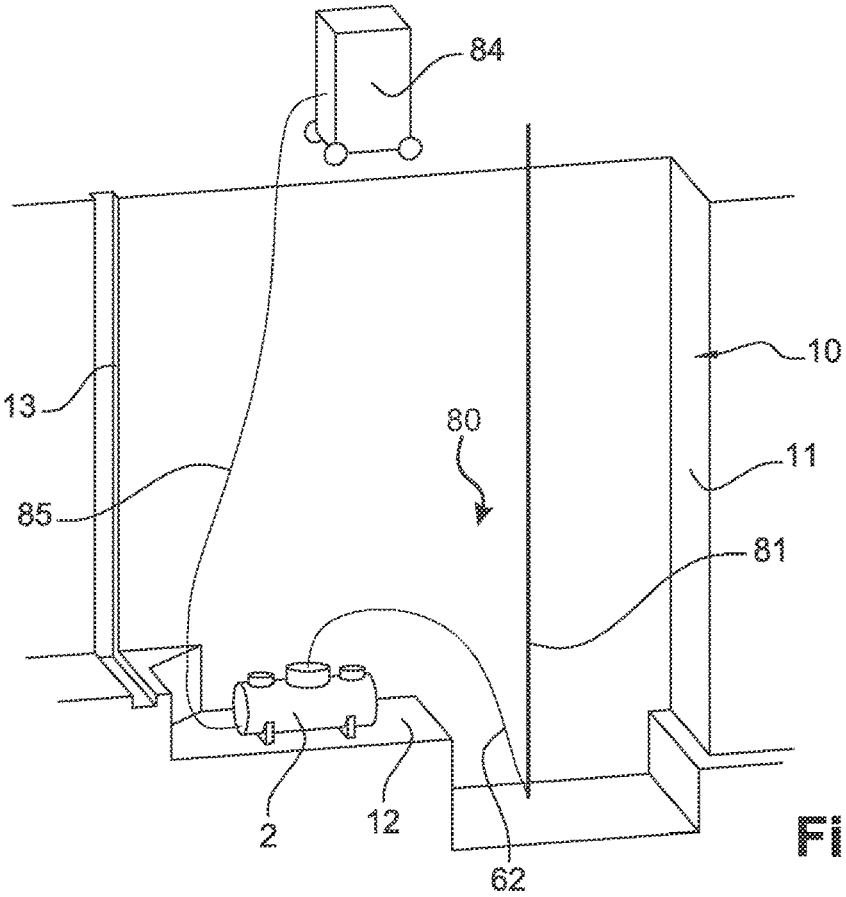
FIG. 6 illustrates the cleaning of the bottom of the pool using the cleaning tool according to the first embodiment.

Referring jointly to FIGS. 4 to 6, the pool 10 comprises two opposite lateral sides 11, 13 and a bottom 12 between the lateral sides 11, 13. The pool 10 contains liquid, typically water. Radioactive elements in suspension, floating elements, or bodies resting on the bottom 12 of the pool are likely to pollute the pool 10.

The cleaning tool 2 comprises a tank 5, a tank 5 support 20, a filtration device 3, a first pumping unit 40, and a second pumping unit 42. The tank 5 accommodates at least partly the pumping units 40, 42 and the filtration device 3.

The cleaning tool 2 comprises an inlet 6 for liquid coming from the pool 10 which leads into the tank 5, a liquid outlet 7 situated downstream of each pumping unit 40, 42 as well as a drainage valve 21 for draining the tank 5.

Hereafter in the disclosure and more particularly with reference to FIG. 4, the terms upstream and downstream are used with reference to the flow of liquid in the cleaning tool 2, during the normal operation of the tool 2.

The filtration device 3 is situated between the first pumping unit 40 and the second pumping unit 42, in the longitudinal direction X-X of the tank 5.

Referring more specifically to FIG. 2, the tank 5 comprises a cylindrical body 51 which is delimited by an exterior wall 50 and extends in the longitudinal direction X-X.

The tanks 5 comprises a central opening 54 for introducing into it the filtration device 3, a first opening 52 for the first pumping unit 40, and a third opening 56 for the second pumping unit 42. These openings 52, 54 56 lead into the cylindrical body 51.

The cylindrical body 51 has the shape of a water tank. It rests on two wall elements 22 with the general shape of an "I" which form the support 20 and are supported on the bottom 12 of the pool 10.

The tank 5 includes a lifting bail 23, called the first bail, which is connected pivotally at its two opposite lateral ends to the cylindrical body 51. The lifting bail 23 makes it possible to move the cleaning tool 2 and to place it at the bottom 12 of the pool 10.

The openings 52, 53, 54 are situated in the upper portion of the cylindrical body 51, opposite to the support 20.

The central opening 54 is situated between the first opening 52 and the third opening 56, along the longitudinal direction X-X of the tank 5.

The central opening 54 is delimited by an annular rim 55 which protrudes from the cylindrical body 51. The first opening 52 is delimited by an annular rim 53 which protrudes from the cylindrical body 51. The third opening 56 is delimited by another annular rim 53 which protrudes from the cylindrical body 51.

The third opening 56 is substantially identical to the first opening 52. The central opening 54 has a greater diameter than that of the first opening 52.

The central opening 54 is designed to be blocked by a cover 61 covering the filtration device 3. The first opening 52 and the third opening 56 are each designed to be blocked by a cover 43 to protect the pumps 41 of the pumping units 40, 42.

The filtration device 3 and the pumping units 40, 42 are used to clean the water of the pool 10, by removing from it radioactive elements, parts or bodies.

The filtration device 3 comprises a plurality of filters 31 of which five are visible in FIG. 2. These filters 31 are accommodated within sockets in the central opening 54, being downstream of the liquid inlet 6. The filters 31 are designed to be integrally accommodated in the tank 5.

Each of the filters 31 is a cartridge filter which includes a handle 33 at its upper end so as to be easily changed, when the cleaning tool 2 is submerged.

Certain filters 31 can be replaced by stoppers (not shown) if the liquid flow rate in the cleaning tool 2 is sufficiently small.

The first pumping unit 40 comprises a first pump 41, a cover 43, a pressure pipe 44 which is fluidly connected to the outlet of the pump 41, and a discharge valve 45. The first pumping unit 40 also includes a lifting lug 46 which is attached to the cover 43, protruding from the cover 43.

The pump 41 is designed to be integrally accommodated in the tank 5 which protects it from the radioactive elements, parts or bodies present in the pool.

The cover 43 is configured to be screwed to the rim 53 of the first opening 52, to close the first opening 52.

The pressure pipe 44 has a bent shape and it passes through the cover 43. It is connected to a discharge pipe 71.

The discharge valve 45 is situated between the pressure pipe 44 and the discharge pipe 71. It is configured to open/close the pressure pipe 44.

A portion of the pressure pipe 44, the discharge valve 45 are situated at the exterior of the tank 5, which facilitates their remote manipulation when the cleaning member 2 is submerged.

The lifting lug 46 is used to grasp the pumping unit 40. The first pumping unit 40 is all the more easily movable because it is movable as a single unit. The maintenance operations of the first pumping unit 40 are then facilitated.

The second pumping unit 42 is identical to the first pumping unit 40.

The pressure pipe 44 of the second pumping unit 42 is also connected to a discharge pipe (not shown) by means of a discharge valve 45.

The central opening 54 is closed by a cover 61 which comprises a plate 69, two inlet tubes 60, an opening lever 91, and a lifting bail 63.

The plate 69 is supported on the central opening 54, which it blocks by being pressed against the annular rim 55 of the opening 54.

Each of the inlet tubes 60 is screwed to the plate 69 and leads through the plate 69. The inlet tubes 60 jointly form the only liquid inlet 6 in the cleaning tube 2 during the normal operation of the cleaning tool 2.

The opening lever 91 is connected pivotally at each of its ends to the plate 69. The opening lever 91 is also connected pivotally at each of its lateral ends to the cylindrical body 51 of the tank by a linear actuator 93, 95.

The opening lever 91 is designed to be grasped when the cleaning tool 2 is submerged, to give access to the filtration device 3 and change the filters 31. It allows the cover 61 to be tilted relative to the tank 5 to give access to the central opening 54.

Each of the linear actuators 93, 95 is connected at one of its longitudinal ends to the cylindrical body 31 by a support 96 around which it is pivotally mounted, and to the lever 91 at its other longitudinal end.

The lever 91 and the linear actuators 93, 95 jointly form an opening/closing system 9 of the cover of the central opening 54.

The cleaning tool 2 comprises two liquid outlets 7 which are situated on either side of the cylindrical body 51, downstream of the pumping units 40, 42. The outlets 7 are oriented opposite to one another in the longitudinal direction X-X of the tank 5. Each outlet 7 is situated at one end of one of the discharge pipes 71, opposite to that at which it is connected to one of the discharge valves 45.

The discharge valve 21 forms a liquid outlet of the tank 5 during maintenance operations. It is attached to the cylindrical body 51 in proximity to the bottom of the tank 5 and in proximity to the support 20. It protrudes toward the exterior of the cylindrical body 51.

Referring jointly to FIGS. 3 to 6, the cleaning tool 2 is configured to be connected electrically to a control and power supply unit 84 by a cable 85. This control and power supply unit 84 is designed to be at the side and at the exterior of the pool 10, when the cleaning tool 2 is at the bottom of the pool 10.

Each of the entry tubes 60 of the cleaning tool 2 is capable to be connected detachably to an inlet pipe 62.

Manipulation tools 80 including poles 81, possibly equipped with clips 82, are used to carry out starting, stopping or maintenance operations on the cleaning tool 2 when it is submerged.

The cleaning tool 2, the power supply unit 84, the cable 85, the inlet pipe 62 and the manipulation tools 80 jointly form a cleaning apparatus 1 of the pool 10.

The control and power supply unit 84 comprises an electrical cabinet designed to be operated by a human operator sheltered from radiation and from radioactive contamination. It is used to both supply electrical power to the cleaning tool 2 and to control the operation of the pumps 41 when the cleaning tool 2 is submerged.

The electrical cable 85 is water resistant. It is used to provide for electrical power supply to the pumps 41 from the power supply unit 84 and to relay commands from the control unit 84 to the pumps 41.

Referring specifically to FIG. 4, the inlet tubes 60 are generally not connected to any inlet pipe 62 when the cleaning tool 2 sucks and filters water from the middle of the pool.

Referring to FIG. 5, the inlet pipes 62 are used to suck water in proximity to the surface of the pool, when they are connected to a surface skimmer 64. The surface skimmer 64 is detachable from the inlet pipes 62.

Referring to FIG. 6, the inlet pipes 62 are used to suck the bottom 12 of the pool when they are held near the bottom 12 of the pool by the poles 81.

The pipes 62 are sufficiently flexible to be moved in the pool 10 by poles 81 with respect to the cleaning tool 2.

Alternatively, the inlet pipes 62 are held and move by means of a robot usable under water controlled from the exterior of the pool, for example a robot of the "Char Huggy" type which is marketed by the Cyberia company.

Depending on the diameter of the inlet tube 62, the inlet tube 62 can be connected to one of the inlet tubes 60 by a nozzle adapter 66.

Figure 3:
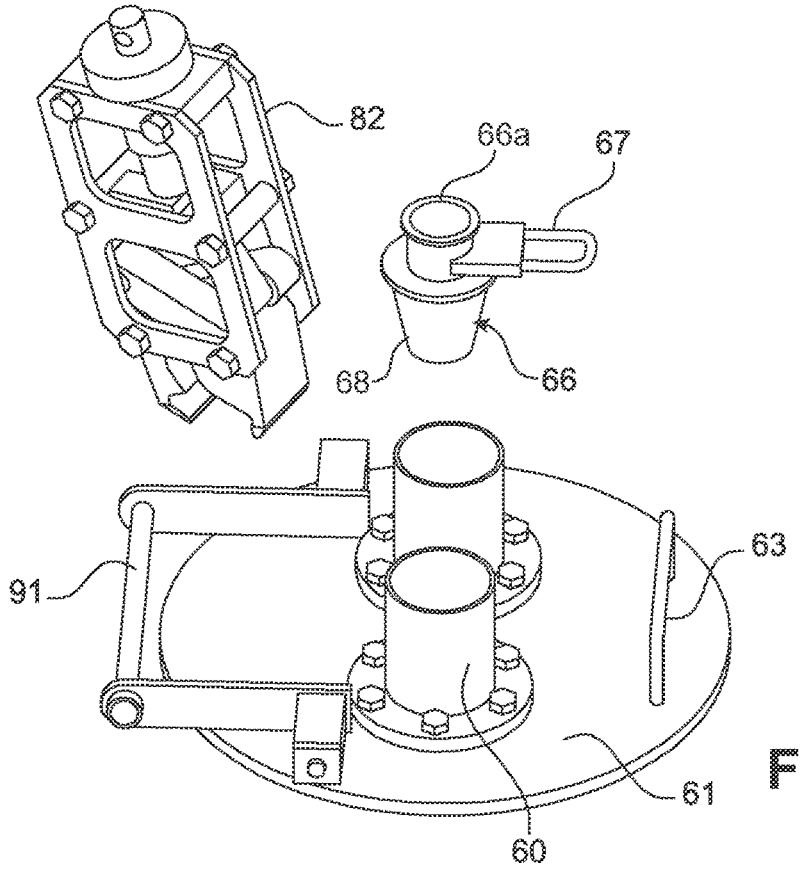
FIG. 3 is a schematic view in elevation illustrating the assembly of an adapting tip at the inlet of the cleaning tool.

The nozzle adapter 66, shown in FIG. 3, includes a frusto-conical exterior surface 68 which is designed to be inserted into the inlet tube 60, by force for example.

It comprises an upper opening 66*a*, opposite to the frusto-conical surface 68 and suited to the diameter of the inlet pipe 62. The nozzle adapters 66 allow pipes 62 of different diameters to be connected to the inlet tubes 60.

The nozzle adapter 66 also includes a gripping lug 67 which allows it to be manipulated using clips 82, when the cleaning tool 2 is submerged.

Moreover, the clips 82 allow the cover 43 of each of the pumping units 40, 42 to be opened by unscrewing it from the tank 5, or by removing the cover 61 of the central opening 54 by pivoting its closure system 9.

The clips 82 are also used to move the cleaning tool 2 by grasping it by the first bail 23, to move the filters 31 by grasping them by their handle 33, and/or to move the pumping units 40, 42 by grasping them by their respective lifting lugs 46.

Finally, the clips 82 allow opening/closing each of the discharge valve 45, and opening/closing the drainage valve 21.

The operation of the cleaning apparatus 1 is illustrated more particularly with reference to FIG. 4.

The tank 5 is filled with water which has fewer contaminants for the pumps 41 or which is substantially free of contaminants for the pumps 41, before being submerged in the pool 10.

The pumps 41 and the filtration device 3 are in place in the tank 5, the openings 52, 54, 56 are blocked by the covers 43, 61, and the drainage valve 21 and the discharge valves 45 are closed, when the cleaning tool 2 is deposited on the bottom 12 of the pool 10.

Afterward, the control unit 84 triggers the operation of each of the pumps 45 and the discharge valves 45 are open.

The liquid initially present in the tank 5 is discharged by the pumps 45 along the flow lines $F_3$, until it enters the pool 10, by each of the outlets 7.

This discharge of liquid, typically clean water, causes a suction of water from the pool through the inlet 6 along the flow line $F_1$. The potentially contaminated water from the pool then passes immediately into the filters 31 along flow line $F_2$. The filters 31 retain the radioactive elements, parts or bodies and other contaminants in suspension in the water of the pool, which limits the pollution of the tanks 5 and of the pumps 41 and avoids damaging the pumps 41.

The water from the pool 10, previously filtered, and which has filled the tank 5, is then sucked by each of the pumps along the flux line $F_3$ to be conveyed to the outlets 7.

With reference to FIG. 5, the inlet 6 is connected to at least one inlet pipe 62. The inlet pipe 62 is connected at its end opposite to that of the inlet 6 to a surface skimmer 64 which sucks the water, the potentially radioactive particles and floating elements and other contaminants in proximity to the surface of the pool.

This water and its contaminants are then led to the inlet 6 under the effect of the suction of the pumps 41, filtered, then discharged as explained above.

With reference to FIG. 6, the entry pipe 62 is held against the bottom 12 of the pool by a pole 81 to suck the water, the radioactive materials and other contaminants which rest on the bottom of the pool.

Once the pool cleaning operations are finished, the tank 5 is drained above the pool by opening the drainage valve 21.

The cleaning tool 2 thus allows the surface, the middle and the bottom of the pool 10 to be cleaned effectively, while protecting the pumps 41 and the tank 6 more effectively from the contamination and from mechanical damage by radioactive elements, parts or bodies, while facilitating the operations of installation, starting and maintenance of the cleaning tool 2.

Of course, different modifications can be applied by a person skilled in the art to the invention which has just been described, without departing from the scope of the disclosure of the invention.

In particular, the openings 52, 54, 56 can be disposed elsewhere than on the upper portion of the tank 5, for example on the side of the tank 5. They may not be aligned.

The cleaning tool 2 can comprise a single pumping unit 40, or more than two pumping units 40, 42.

The tank 5 may not have a lifting bail 23.

The cleaning tool may have no discharge pipe 71. In this case, the outlet 7 are situated at the discharge valves 45.

Moreover, the number of inlets 6 and of outlets 7 can vary depending on the flow rate of liquid circulating in the cleaning tool 2.

What is claimed is:

1. A cleaning tool for a pool in a radioactive environment, comprising:

a liquid filtration device and at least one pump, wherein the cleaning tool comprises a tank which includes:

a first opening for positioning the pump at least partly in the tank, a second opening, distinct from the first opening, for positioning the liquid filtration device at least partly in the tank, a liquid inlet from the pool, wherein the liquid inlet leads into the second opening, wherein the liquid filtration device is situated between the liquid inlet and the pump to fluidly connect the liquid inlet to the pump, a liquid outlet, wherein the cleaning tool comprises a cover for closing the first opening, and a pressure pipe which is fluidly connected to an outlet of the pump and to the liquid outlet, wherein the pressure pipe passes through the cover, wherein the pump and the pressure pipe are rigidly integrated into the cover.

2. The cleaning tool according to claim 1, wherein the pump is attached to the tank, and wherein the liquid filtration device is attached to the tank.

3. The cleaning tool according to claim 1, wherein the cleaning tool comprises one cover for blocking the second opening and a closure system for the cover, wherein the closure system comprises:

a lever, and two linear actuators each connected on the one hand to the tank and on the other hand to the lever, wherein the linear actuators tilt the cover relative to the tank.

4. The cleaning tool according to claim 1, comprising a valve for closing the pressure pipe, wherein the valve is situated opposite to the pump with respect to the cover of the first opening.

5. The cleaning tool according to claim 1, comprising:

a second pump positioned in the tank through a third opening distinct from the first opening, wherein the first opening and the third opening are situated on either side of the second opening for the introduction of the liquid filtration device, wherein the liquid filtration device is positioned in the tank between the pumps in a longitudinal direction of the tank.

6. The cleaning tool according to claim 1, comprising a drainage valve which is situated at the exterior of the tank for draining the tank.

7. A cleaning apparatus for a pool in a radioactive environment, wherein the cleaning apparatus comprises:

a cleaning tool according to claim 1, and a control and/or power supply unit for controlling the pump and/or to supply electrical power to the pump from outside the pool when the cleaning tool is at the bottom of the pool.

8. The cleaning apparatus according to claim 7, comprising an inlet pipe fluidly connected to the liquid inlet of the cleaning tool for sucking the liquid at the surface of the pool or at the bottom of the pool.

9. The cleaning apparatus according to claim 8, wherein the liquid inlet comprises at least one inlet tube, wherein the cleaning apparatus comprises a nozzle adapter which connects fluidly the inlet pipe to the inlet tube, wherein the nozzle adapter comprises a gripping lug and a frusto-conical surface dimensioned to be inserted into the inlet tube.

10. A method for cleaning a pool in a radioactive environment, by means of a cleaning tool comprising:

a liquid filtration device and at least one pump, wherein the cleaning tool comprises a tank which includes:

a first opening for positioning the pump at least partly in the tank, a second opening, distinct from the first opening, for positioning the liquid filtration device at least partly in the tank, a liquid inlet from the pool, wherein the liquid inlet leads into the second opening, wherein the liquid filtration device is situated between the liquid inlet and the pump to fluidly connect the liquid inlet to the pump, a liquid outlet, wherein the cleaning tool comprises a cover for closing the first opening, and a pressure pipe which is fluidly connected to an outlet of the pump and to the liquid outlet, wherein the pressure pipe passes through the cover, wherein the pump and the pressure pipe are rigidly integrated into the cover, wherein the method for cleaning the pool comprises:

a step of submerging the cleaning tool in the pool, wherein the tank is previously filled with a first liquid having fewer or being free of contaminants for the pump, and a step of triggering the operation of the pump.

11. A method for remotely connecting an inlet pipe to an inlet tube of a cleaning apparatus for a pool in a radioactive environment, wherein the cleaning apparatus comprises a cleaning tool comprising:

a liquid filtration device and at least one pump, wherein the cleaning tool comprises a tank which includes:

a first opening for positioning the pump at least partly in the tank, a second opening, distinct from the first opening, for positioning the liquid filtration device at least partly in the tank, a liquid inlet from the pool, wherein the liquid inlet leads into the second opening, wherein the liquid filtration device is situated between the liquid inlet and the pump to fluidly connect the liquid inlet to the pump, a liquid outlet, wherein the cleaning tool comprises a cover for closing the first opening, and a pressure pipe which is fluidly connected to an outlet of the pump and to the liquid outlet, wherein the pressure pipe passes through the cover, wherein the pump and the pressure pipe are rigidly integrated into the cover, and wherein the cleaning apparatus comprises a control and/or power supply unit for controlling the pump and/or to supply electrical power to the pump from outside the pool when the cleaning tool is at the bottom of the pool, wherein the cleaning apparatus comprises an inlet pipe fluidly connected to the liquid inlet of the cleaning tool for sucking the liquid at the surface of the pool or at the bottom of the pool, wherein the liquid inlet comprises at least one inlet tube, wherein the cleaning apparatus comprises a nozzle adapter which connects fluidly the inlet pipe to the inlet tube, wherein the nozzle adapter comprises a gripping lug and a frustoconical surface dimensioned to be inserted into the inlet tube, wherein the method for remotely connecting the inlet pipe to the inlet tube of the cleaning apparatus comprises:

a step of grasping the nozzle adapter by its lug from the outside of the pool, and a step of inserting the nozzle adapter into the inlet tube from the outside of the pool.

* * * * *